US011825947B1

(12) United States Patent
Plocher

(10) Patent No.: US 11,825,947 B1
(45) Date of Patent: Nov. 28, 2023

(54) FLOATING SHELF SYSTEM

(71) Applicant: Silicate Studio Home, LLC, Rexburg, ID (US)

(72) Inventor: Riley Plocher, Rexburg, ID (US)

(73) Assignee: Silicate Studio Home, LLC, Rexburg, ID (US)

( * ) Notice: Subject to any disclaimer, the term of this patent is extended or adjusted under 35 U.S.C. 154(b) by 0 days.

(21) Appl. No.: 17/751,095

(22) Filed: May 23, 2022

(51) Int. Cl.
*A47B 96/06* (2006.01)

(52) U.S. Cl.
CPC ..... *A47B 96/067* (2013.01); *A47B 96/061* (2013.01); *A47B 96/066* (2013.01)

(58) Field of Classification Search
CPC .... A47B 96/061; A47B 96/066; A47B 96/067
See application file for complete search history.

(56) References Cited

U.S. PATENT DOCUMENTS

| | | | | |
|---|---|---|---|---|
| 3,041,033 | A * | 6/1962 | Schwartz | A47B 96/061 248/248 |
| 3,193,885 | A | 7/1965 | Gartner et al. | |
| 8,082,859 | B2 | 12/2011 | Sevack | |
| 9,861,198 | B2 | 1/2018 | Anderson | |
| 10,294,679 | B2 | 5/2019 | Muth | |
| 11,013,326 | B2 | 5/2021 | Graber et al. | |
| 11,432,648 | B1 * | 9/2022 | Black | A47B 96/066 |
| 2004/0007423 | A1 * | 1/2004 | Scott | A47B 96/061 182/113 |
| 2007/0125738 | A1 * | 6/2007 | Sevack | A47B 96/066 211/187 |
| 2018/0245356 | A1 * | 8/2018 | Muth | A47B 96/027 |
| 2022/0071401 | A1 | 3/2022 | Clary | |

FOREIGN PATENT DOCUMENTS

WO WO 2021/217234 A1 11/2021

* cited by examiner

*Primary Examiner* — Matthew W Ing
(74) *Attorney, Agent, or Firm* — Thorpe North & Western, LLP.

(57) ABSTRACT

A floating shelf system for a desk provides floating shelf brackets with plates mounted to both sides of a stud in a wall. A beam extends from the plates and have a fork with a pair of prongs secured along side the plates. The beam and the prongs are formed by a pair of outer square tubes and a center rectangular tube. The tubes form a rectangular and oblong cross-section with a pair of webs.

20 Claims, 4 Drawing Sheets

FLOATING SHELF SYSTEM

BACKGROUND

Shelves can he attached to walls using various support brackets. Some support brackets for war-mounted shelves are able to support more weight than others. Brackets that are able to support more weight tend to be bulkier and more visible than brackets that support less weight. A consumer may find a highly visible support bracket on a wall to be undesirable in a room where the consumer wishes to establish a certain decor. The development of shelving solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
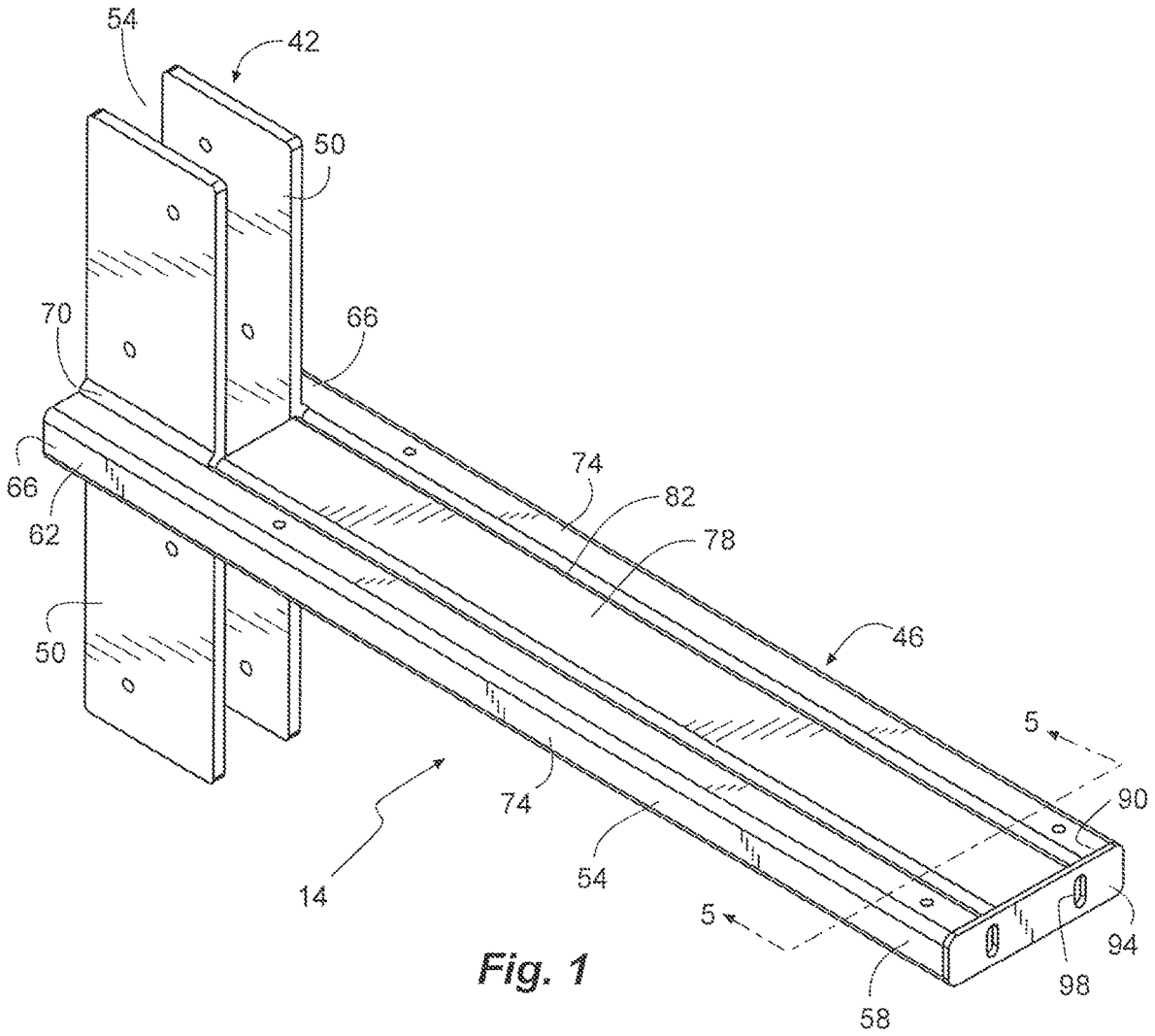
FIG. 1 is a perspective view of a floating shelf bracket in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present application provides various examples of floating shelf bracket and a floating shelf system for mounting a shelf, such as a desk, to a flat vertical surface, such as a wail. Examples and configurations disclosed herein provide brackets that have a high ratio of weight-supporting capacity to visibility relative to previous wall-mountable shelf-support apparatuses.

When decorating a room, a consumer may wish to a mount shelf or desk to one or more wails in order to provide increased space for display, storage and/or work. Some wall-mountable shelf-support brackets are commercially available. Many such brackets are mounted below the shelves they support and therefore remain visible beneath the shelves after installation is complete. Other varieties of shelf-support brackets are mounted above the shelves they support, but likewise remain visible after installation is complete.

Some consumers may wish to mount a shelf or desk to a wall, but may not wish for the bracket that supports the shelf or desk to be conspicuously visible. A shelf or desk that is supported by a bracket that is not conspicuously visible is sometimes referred to as a floating shelf, since the shelf may appear to float due to the low visibility of the supporting bracket.

With some brackets there is often a tradeoff between visibility and weight-supporting strength because a bracket that is less conspicuous tends to be smaller and tends to absorb the stress of weight borne by a shelf over a smaller area. Consequently, consumers who wish to store or display relatively heavy items on floating shelves, or utilize a floating desk, may have difficulty finding brackets that provide both a desired high level of weight-bearing capacity and a desired low level of bracket visibility.

Brackets designed in accordance with the design principles described in the present disclosure provide a high ratio of weight-supporting capacity to visibility relative to existing commercial support brackets for floating shelves. In one example, brackets are contained in and hidden by a wall and a shelf. A wall portion of each bracket is received within the wall behind a wall panel, such as drywall, and a shelf portion of each bracket is received within a bore of the shelf. Thus, the bracket is hidden, and the shelf appears to float with respect to the wail.

The bracket has a pair of vertical plates that are spaced-apart from one another and with a gap between the plates. The plates and the gap receive a stud of the wall. The plates adjoin and couple to the stud, such as with screws or nails. The plates can have a size with a depth matching a depth of the stud, such as 3 inches, with depth measured into the wall and along the bracket. In addition, the plates can have a height greater than the depth, such as 12 inches, with height measured vertically and parallel with the wall. Thus, the bracket is coupled to a side of the studs rather than just a front of the studs for greater strength and greater ability to support loads. In addition, the bracket is coupled to the studs above and below a cantilevered beam for greater strength and support ability. Each bracket also has a horizontal cantilevered beam coupled to and extending from the pair of plates. The beam extends through a horizontal slot in the wall panel and into the bore of the shelf. The beam has a proximal end coupled to the pair of plates and a distal free end.

in one aspect, the beam can have a fork with two prongs at the proximal end. The prongs receive the pair of plates between the prongs. The prongs extend along a majority of the depth of the plates. The prongs are coupled to the pair of plates along an entire length of the prongs, such as by welding. Thus, the beam is coupled from a back to the front of the plates, rather than just being coupled to the front to provide greater strength and greater ability to support loads.

In another aspect, the prongs can be a pair of square tubes. A center rectangular tube can be coupled between the square tubes. The square tubes and the center rectangular tube together form a rectangular and/or oblong cross-section. A pair of intermediate webs can extend between a top and a bottom of the rectangular cross-section. Thus, the beam can support greater lengths. In one aspect, the beam can have a length of from the plates to the distal free end between 12 to 24 inches.

In another aspect, the shelf can be a desk. In one aspect, the desk can be mounted so that an upper working surface is elevated at substantially 28 to 32 inches from the floor for a seated desk, or substantially 36 to 42 inches for a raised bar desk or standing desk. In another aspect, the desk can have a depth between 18 to 30 inches. The brackets and the floating shelf system can support 180 lbs up to 18" deep, 80 lbs up to 24" deep, and 45 lbs up to 30" deep.

Figure 2:
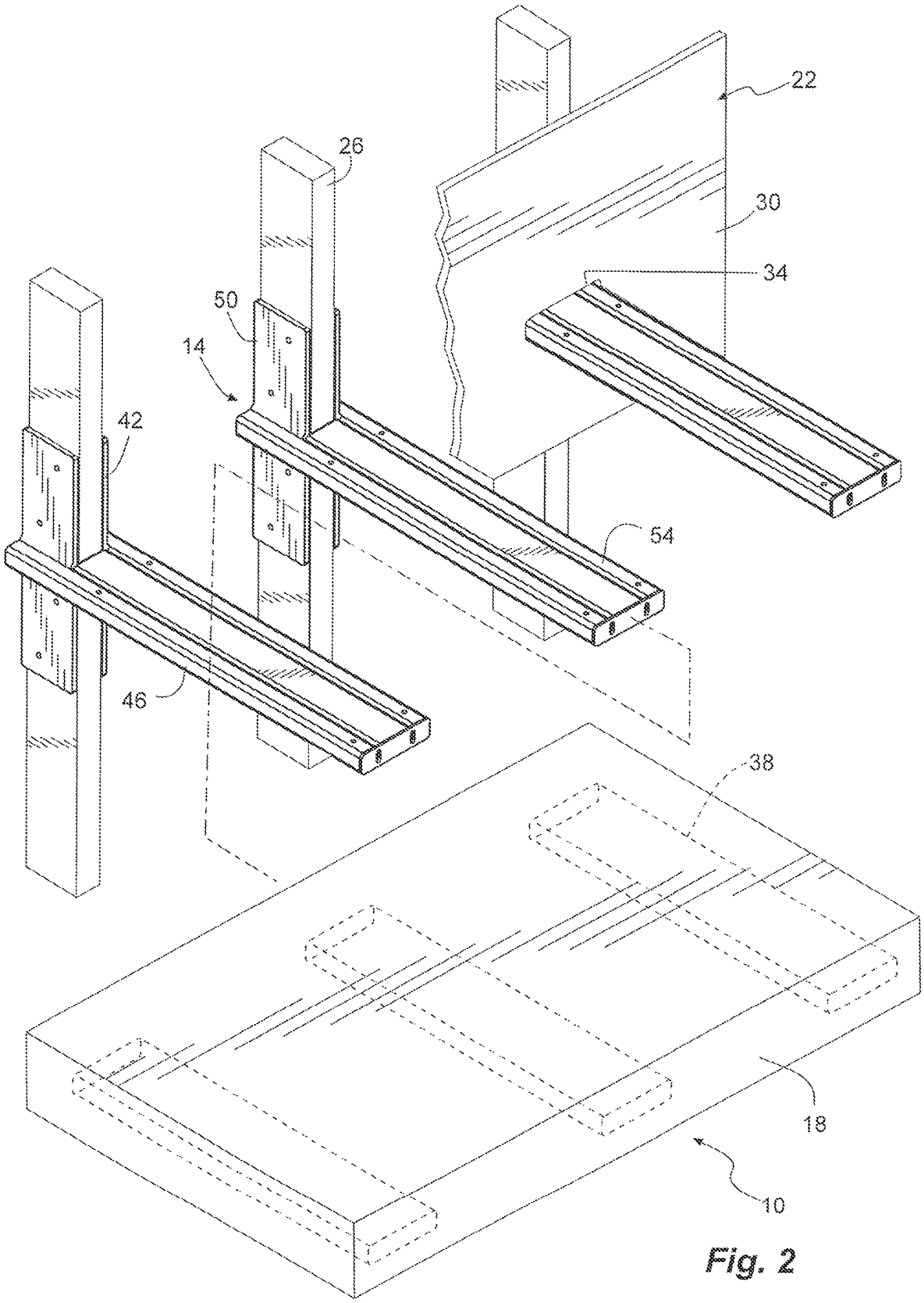
FIG. 2 is a partial perspective schematic view of a floating shelf system in accordance with an embodiment of the invention with a bracket of FIG. 1 mounted to a wail to support a shelf, such as a desk.
Figure 3:
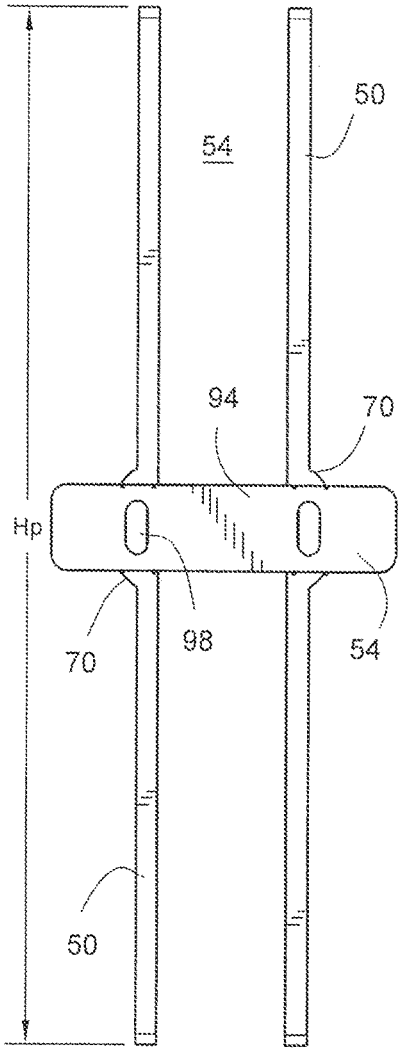
FIG. 3 is a front end view of the bracket of FIG. 1.
Figure 4:
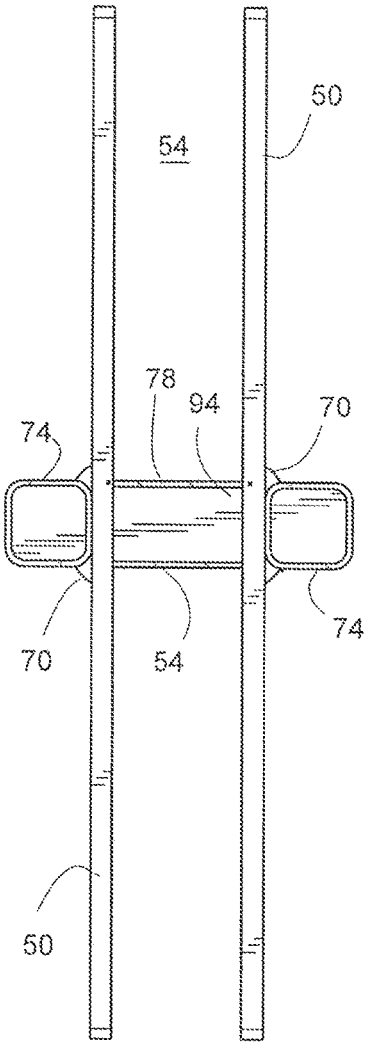
FIG. 4 is a rear end view of the bracket of FIG. 1.
Figure 5:
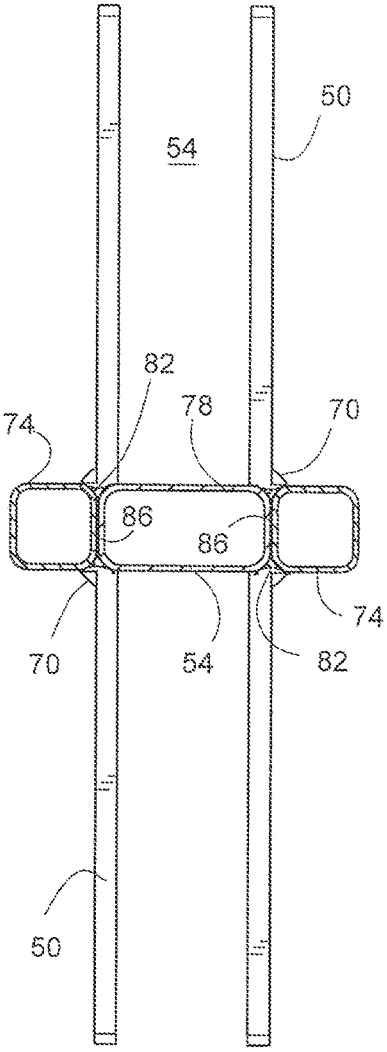
FIG. 5 is a cross-sectional end view of the bracket of FIG. 1 taken along line 5 of FIG. 1.

Referring to FIGS. 1-7, a floating shelf system 10 with at least one floating shelf bracket 14 is shown in an exemplary embodiment. In another aspect, the system 10 can have multiple brackets 14, such as at least two brackets 14 or at least three brackets 14. Referring to FIG. 2, the system 10 can comprise a shelf, such as a desk 18, mounted to a wall 22. The wall 22 can have at least one stud 26 in one aspect. In another aspect, the wail 22 can have multiple studs 26, such as at least two studs 26 or at least three studs 26. The wall 22 can also have a wall panel, such as drywall 30, covering the studs 26. The wail panel can have a finished surface, such as painted. The studs 26 and the wall panel 30 can be vertically oriented and can extend from a support surface, such as the floor, to a ceiling. The wall panel 30 can have at least one horizontal slot 34 aligned with a respective stud 26. In another aspect, the wall panel 30 can have multiple slots 34, such as at least two slots 34 or at least three slots 34, each aligned with a different stud 26.

The brackets 14 are mounted to and carried by the studs 26. In one aspect, each bracket 14 can be mounted to a different stud 26. Thus, the system 10 can have a horizontal array of brackets 14. The shelf or desk 18 is mounted to and carried by the bracket 14. The shelf or desk 18 can have at least one bore 38 in one aspect. In another aspect, the shelf or desk 18 can have multiple bores 38, such as at least two bores 38 or at least three bores 38. The bores 38 can extend from a back of the shelf or desk 18 and can have an opening through the back. The bores 38 can be aligned with the brackets 14 and the slots 34 of the wall panel 30. The brackets 14 are contained in and hidden by the wall 22 and the shelf or desk 18. A wall portion 42 of the brackets 14 can be received within the wail 22 and behind the wall panel 30 while a shelf portion 46 of the brackets can be received within the bores 38 of the shelf or desk 18.

Figure 6:
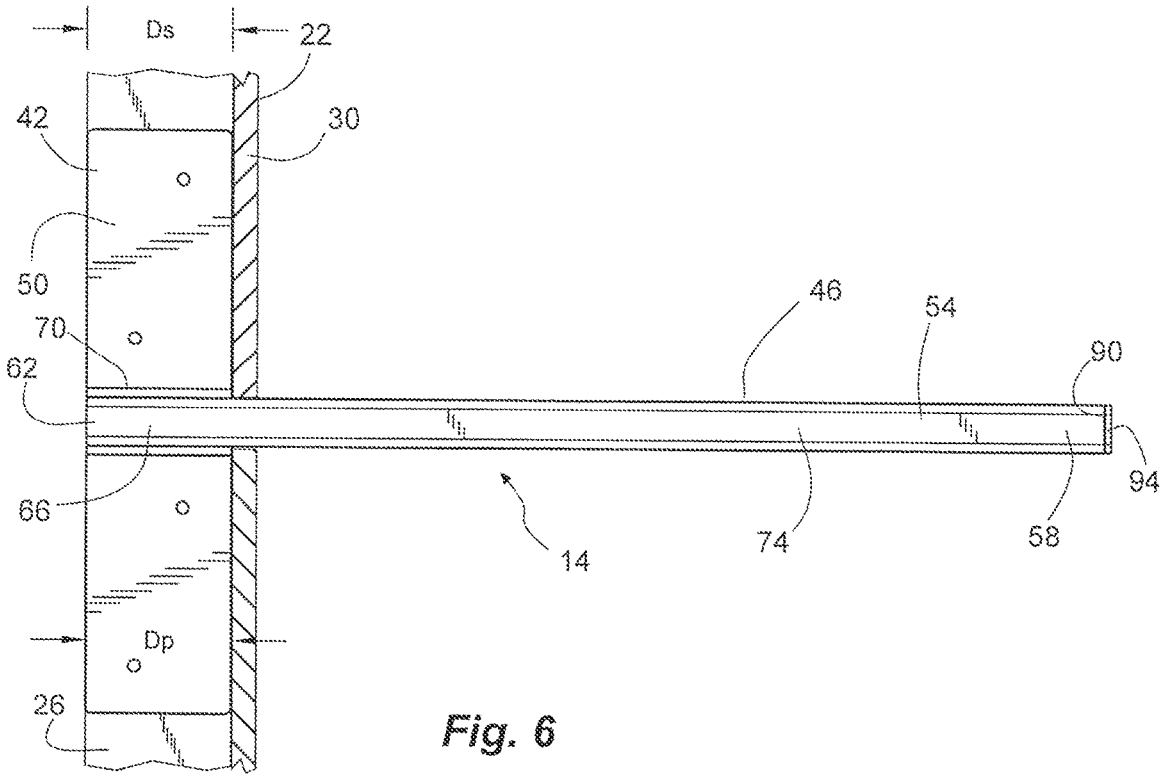
FIG. 6 is a right side view of the bracket of FIG. 1 shown mounted to a stud and protruding through a wall panel of the wall. The left side view can be a mirror image.
Figure 7:
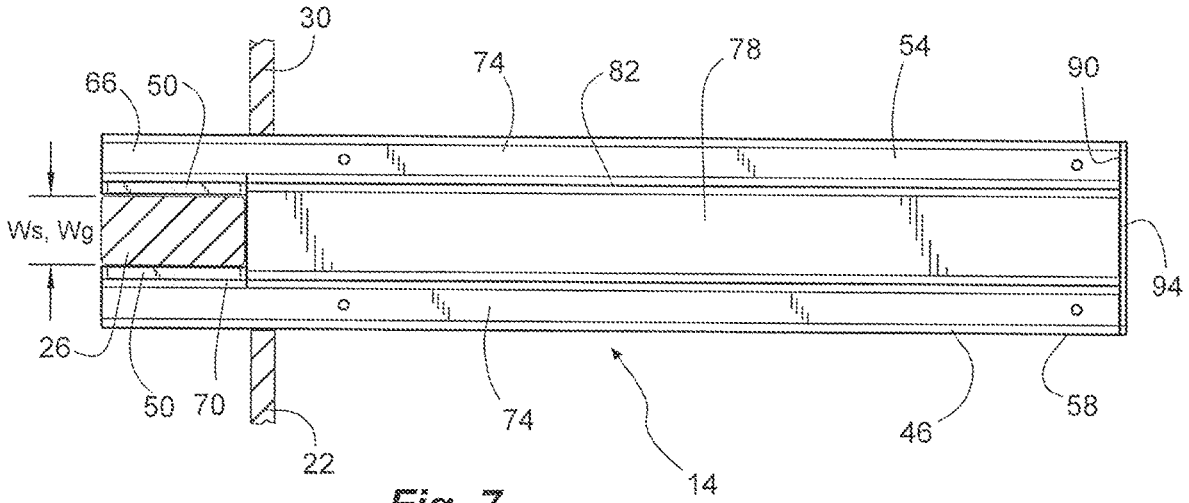
FIG. 7 is a top view of the bracket of FIG. 1 shown mounted to the stud and protruding through the wall panel of the wall. The bottom view can be a mirror image.

Referring again to FIGS. 1-7, each of the brackets 14 can have a pair of plates 50 to be located in the wall 22 and fastened to a stud 26. The plates 50 are spaced-apart from one another and having a gap 54 to receive the stud 26. The distance between the plates 50 and a width Wg of the gap 54 can be substantially the same as the width Ws of the stud 26, such as 1 ½ inches, with width measured horizontally and parallel to the wail, as shown in FIG. 7. Thus, the plates 50 adjoin opposite sides of the stud 26 and couple to the stud 26 with fasteners, such as screws or nails. The plates 50 can be vertically oriented to extend up and down the stud 26 with respect to the slot 34. The plates 50 can have a depth Dp substantially the same as a depth Ds of the stud 26, as shown in FIG. 6. In one aspect, the depth Dp of the plates 50 can be substantially 3 inches. The plates 50 can also have a heigh Hp greater than the depth Dp. In one aspect, the height Hp of the plates 50 can be three times the depth Dp, such as 12 inches, to spread the applied forces over a greater height of the stud 26, and to reduce torque applied to the fasteners and the stud 26. The plates 50 can have multiple apertures at multiple different elevations with respect to the stud 26 to receive fasteners therethrough and space the fastener along the stud 26.

Each of the brackets 14 can also have a horizontal cantilevered beam 54 coupled to and extending from the pair of plates 50. The beam 54 also extends through the horizontal slot 34 and into the bore 38 of the shelf or desk 18. The beam 54 has a proximal end coupled to the pair of plates 50 and a distal free end 58.

Each beam 54 can have a fork 62 with two prongs 66 at the proximal end of the beam 54. The fork 62 and prongs 66 receive the plates 50 between the prongs 66. The prongs 66 can extend along a majority of the depth Dp of the plates 50. In another aspect, the prongs 66 can have a length and can extend the entire depth Dp of the plates 66. The prongs 66 are coupled to the plates 50 along an entire length of the prongs 66. In one aspect, the prongs 66 can be welded to the plates 50 and coupled by a weld bead 70 extending along an entire overlap between the prongs 66 and the plates 50, and on both a top and a bottom of the prongs 66. Thus, the brackets 14 can support a greater weight.

The beam 54 can be formed by metal tubing, such as square and rectangular tubes. The prongs 66 can comprise a pair of square tubes 74, For example, the square tubes 74 can be 1×1 inch square tube. The square tubes 74 can be coupled to the plates 50, such as by welding, and along their entire length and an entire depth Dp of the plates 50, as described above. A center rectangular tube 78 can be coupled between the pair of square tubes 74. In one aspect, the center rectangular tube 78 can be coupled to the square tubes by welding and can form weld beads 82 along an entire length of the center rectangular tube 78, and on both a top and a bottom of the tubes 74 and 78. The rectangular tube 78 can have a width the same as the width between the outsides of the plates 50. For example, the rectangular tube 78 can be 1×2 inch rectangular tube. The plates 50 can be metal with a thickness of ¼ inch. The square tubes 74 and the center rectangular tube 78 can together form a rectangular and oblong cross-section. The rectangular and oblong cross-section can substantially match and mate with the slot 34 in the wall panel 30. In addition, the tubing 74 and 78 can provide a pair of intermediate webs 86 (FIG. 5) extending between a top and a bottom of the rectangular and oblong cross-section. The webs 86 can provide additional strength to the beam 54.

In another aspect, the square tubes 74 and the center rectangular tube 78 can have open free ends 90. A cap 94 can cover the open free ends 90 of the tubes 74 and 78. At least one aperture 98 can be formed in the cap 94 to receive a fastener.

Various aspects of floating shelves are described and shown in U.S. Pat. No. 9,861,198, filed Mar. 30, 2016, and U.S. Provisional Patent Application No. 63/270,723, filed Oct. 22, 2021, which are hereby incorporated herein by reference.

As used in this specification and the appended claims, the singular forms “a,” “an” and “the” include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top" "bottom," "over" "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed, The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result: For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples, in the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A floating shelf system comprising:

a) a wall with at least two studs and a wall panel covering the at least two studs, the wall panel having at least two horizontal slots aligned with the at least two studs;

b) at least two floating shelf brackets mounted to and carried by the at least two studs with each bracket mounted to a different one of the at least two studs;

c) a shelf mounted to and carried by the at least two floating shelf brackets, and having at least two bores aligned with the at least two floating shelf brackets;

d) the at least two floating shelf brackets being contained in and hidden by the wall and the shelf with a wall portion of each bracket received within the wall behind the wall panel and a shelf portion of each bracket received within the at least two bores of the shelf; and e) each of the at least two floating shelf brackets comprising:

i) a pair of vertical plates spaced-apart from one another and having a gap receiving one of the at least two studs therebetween with the pair of plates adjoining and coupled to the stud therebetween, each plate having a depth substantially the same as a depth of the stud, and a height greater than the depth;

ii) a horizontal cantilevered beam coupled to and extending from the pair of plates and through one of the at least two horizontal slots and into one of the at least two bores of the shelf, the beam having a proximal end coupled to the pair of plates and a distal free end, the horizontal cantilevered beam comprising:

iii) a fork with two prongs at the proximal end of he beam receiving the pair of plates between the prongs;

iv) the prongs extending along a majority of the depth of the pair of plates;

v) the prongs coupled to the pair of plates along an entire length of the prongs;

vi) the two prongs comprising a pair of square tubes;

vii) a center rectangular tube coupled between the pair of square tubes; and viii) the pair of square tubes and the center rectangular tube together forming a rectangular cross-section with a pair of intermediate webs extending between a top and a bottom of the rectangular cross-section.

2. The system in accordance with claim 1 wherein the shelf is a desk with an upper working surface elevated at substantially 28 to 32 inches.

3. The system in accordance with claim 1, wherein the prongs are coupled to the pair of plates by a weld bead extending along an entire overlap between the prongs and the pair of plates on both a top and a bottom of the prongs.

4. The system in accordance with claim 1, wherein the center rectangular tube is coupled to the pair of square tubes by weld beads along an entire length of the center rectangular tube.

5. The system in accordance with claim 1, further comprising:

the pair of square tubes and the center rectangular tube having open free ends;

a cap covering the open free ends; and at least one aperture in the cap configured to receive a fastener.

6. A bracket for a floating shelf system, the bracket comprising:

a) a pair of plates spaced-apart from one another by a gap configured to receive a stud therebetween and configured to be coupled to the stud, each plate having a height greater than a depth;

b) a horizontal cantilevered beam coupled to and extending from the pair of plates and configured to extend through a slot in a wall panel coving the stud, the beam having a proximal end coupled to the pair of plates and a distal free end, the horizontal cantilevered beam comprising:

c) a fork with two prongs at the proximal end of the beam receiving the pair of plates between the prongs;

d) the prongs extending along a majority of the depth of the pair of plates;

e) the prongs coupled to the pair of plates along an entire length of the prongs; and f) the two prongs comprising a pair of square tubes.

7. The bracket in accordance with claim 6, wherein the prongs are coupled to the pair of plates by a weld bead extending along an entire overlap between the prongs and the pair of plates on both a top and a bottom of the prongs.

8. The bracket in accordance with claim 6, wherein the horizontal cantilevered beam further comprises:

a) a center rectangular tube coupled between the pair of square tubes; and b) the pair of square tubes and the center rectangular tube together forming a rectangular cross-section with a pair of intermediate webs extending between a top and a bottom of the rectangular cross-section.

9. The bracket in accordance with claim 8, wherein the center rectangular tube is coupled to the pair of square tubes by weld beads along an entire length of the center rectangular tube.

10. The bracket in accordance with claim 8, further comprising:

the pair of square tubes and the center rectangular tube having open free ends;

a cap covering the open free ends; and at least one aperture in the cap configured to receive a fastener.

11. A floating shelf system comprising at east two brackets in accordance with claim 6, the system further comprising:

a) a wall with at least two studs and a wall panel covering the at least two studs, the wall panel having at least two horizontal slots aligned with the at least two studs;

b) the at least two brackets mounted to and carried by the at least two studs with each bracket mounted to a different one of the at least two studs;

c) a shelf mounted to and carried by the at least two brackets, and having at least two bores aligned with the at least two brackets; and d) the at least two brackets being contained in and hidden by the wall and the shelf with a wall portion of each bracket received within the wall behind the wall panel and a shelf portion of each bracket received within the shelf.

12. The bracket in accordance with claim 6, further comprising:

a desk mounted to and carried by the bracket, and having a bore receiving the beam of the bracket.

13. The bracket in accordance with claim 12, further comprising:

the beam of the bracket having an oblong cross-sectional shape with a width greater than a height; and the bore of the desk having an oblong cross-sectional shape with a width greater than a height and substantially matching a cross-sectional shape of the beam.

14. A bracket for a floating shelf system, the bracket comprising:

a) a pair of plates spaced-apart from one another by a gap configured to receive a stud therebetween and configured to be coupled to the stud, each plate having a height greater than a depth;

b) a horizontal cantilevered beam coupled to and extending from the pair of plates and configured to extend through a slot in a wall panel covering the stud, the beam having a proximal end coupled to the pair of plates and a distal free end, the beam comprising:

c) a pair of square tubes spaced-apart from one another and receiving the pair of plates therebetween;

d) a center rectangular tube coupled between the pair of square tubes; and e) the pair of square tubes and the center rectangular tube together forming a rectangular cross-section with a pair of intermediate webs extending between a top and a bottom of the rectangular cross-section.

15. The bracket in accordance with claim 14, wherein the center rectangular tube is coupled to the pair of square tubes by weld beads along an entire length of the center rectangular tube.

16. The bracket in accordance with claim 15, further comprising:

the pair of square tubes and the center rectangular tube having open free ends;

a cap covering the open free ends; and at least one aperture in the cap configured to receive a fastener.

17. The bracket in accordance with claim 14, further comprising:

a) the pair of square tubes forming a fork with two prongs at the proximal end of the beam receiving the pair of plates between the prongs;

b) the prongs extending along a majority of the depth of the pair of plates; and c) the prongs coupled to the pair of plates along an entire length of the prongs.

18. The bracket in accordance with claim 17, wherein the prongs are coupled to the pair of plates by a weld bead extending along an entire overlap between the prongs and the pair of plates.

19. A floating shelf system comprising at least two brackets in accordance with claim 14, the system further comprising:

a) a wall with at least two studs and a wall panel covering the at least two studs, the wall panel having at least two horizontal slots aligned with the at least two studs;

b) the at least two brackets mounted to and carried by the at least two studs with each bracket mounted to a different one of the at least two studs;

c) a shelf mounted to and carried by the at least two brackets, and having at least two bores aligned with the at least two brackets; and d) the at least two brackets being contained in and hidden by the wall and the shelf with a wall portion of each bracket received within the wall behind the wall panel and a shelf portion of each bracket received within the shelf.

20. The bracket in accordance with claim 14, further comprising:

a desk mounted to and carried by the bracket, and a bore receiving the beam of the bracket.

* * * * *